US008938890B2

(12) United States Patent
Raghuprasad

(10) Patent No.: US 8,938,890 B2
(45) Date of Patent: Jan. 27, 2015

(54) EXPANDABLE SHOE

(76) Inventor: Puthalath Koroth Raghuprasad, Odessa, TX (US)

( * ) Notice: Subject to any disclaimer, the term of this patent is extended or adjusted under 35 U.S.C. 154(b) by 337 days.

(21) Appl. No.: 13/303,875

(22) Filed: Nov. 23, 2011

(65) Prior Publication Data

US 2013/0125420 A1 May 23, 2013

(51) Int. Cl.

| | |
|---|---|
| ***A43B 7/14*** | (2006.01) |
| ***A43B 3/26*** | (2006.01) |
| ***A43B 23/07*** | (2006.01) |
| ***A43B 5/00*** | (2006.01) |
| ***A43B 7/28*** | (2006.01) |
| ***A43B 23/28*** | (2006.01) |
| ***A43B 23/04*** | (2006.01) |
| ***A43B 21/06*** | (2006.01) |
| ***A43B 23/02*** | (2006.01) |
| *A43B 1/00* | (2006.01) |
| *A43B 3/00* | (2006.01) |
| *A43B 3/30* | (2006.01) |
| *A43B 5/04* | (2006.01) |
| *A63C 17/00* | (2006.01) |

(52) U.S. Cl.

CPC ..... *A43B 7/14* (2013.01); *A43B 1/0072* (2013.01); *A43B 3/0078* (2013.01); *A43B 3/30* (2013.01); *A43B 5/00* (2013.01); *A43B 5/0405* (2013.01); *A43B 7/28* (2013.01); *A43B 23/07* (2013.01); *A43B 23/28* (2013.01); *A63C 17/0086* (2013.01); *A43B 3/26* (2013.01); *A43B 23/047* (2013.01); *A43B 3/0063* (2013.01); *A43B 21/06* (2013.01); *A43B 23/0265* (2013.01); *A43B 23/0295* (2013.01)

USPC ..... 36/88; 36/97; 36/93; 36/55

(58) Field of Classification Search

CPC ..... A43B 23/07; A43B 23/28; A43B 5/00; A43B 7/14; A43B 5/0405; A43B 7/28; A43B 3/26; A43B 3/30; A43B 1/0072; A43B 3/0078; A62C 17/0086

USPC ..... 36/97, 55, 88, 93

See application file for complete search history.

(56) References Cited

U.S. PATENT DOCUMENTS

| | | | | | |
|---|---|---|---|---|---|
| 3,389,481 | A | * | 6/1968 | England | 36/97 |
| 3,404,468 | A | * | 10/1968 | Rosen | 36/11 |
| 3,541,708 | A | | 11/1970 | Rosen | |
| 3,686,777 | A | | 8/1972 | Rosen | |
| 4,060,918 | A | | 12/1977 | Mandel | |

(Continued)

FOREIGN PATENT DOCUMENTS

| | | |
|---|---|---|
| CN | 201267212 | 7/2009 |
| CN | 201290380 | 8/2009 |

(Continued)

*Primary Examiner* — Clinton T Ostrup
*Assistant Examiner* — Cameron A Carter
(74) *Attorney, Agent, or Firm* — David L King

(57) ABSTRACT

An expandable shoe has a top portion, a pair of side portions, a back portion, a sole, a heel and a first elastic member. The first elastic member joins the top portion to the pair of side portions at a critical location which is at the junction of the top portion and the side portions. The first elastic member is in the shape of an inverted "U" extending along the front of the shoe. The expandable shoe may further have a second elastic member joining the back portion to the side portions at the critical locations at the junctions of the back and side portions and the junctions of the back and the rear of the sole. The second elastic member is in the shape of an upright "U".

14 Claims, 6 Drawing Sheets

(56) References Cited

U.S. PATENT DOCUMENTS

| | | | | |
|---|---|---|---|---|
| 4,736,531 | A * | 4/1988 | Richard | 36/114 |
| 4,944,099 | A * | 7/1990 | Davis | 36/97 |
| 5,060,402 | A * | 10/1991 | Rosen | 36/97 |
| 5,123,181 | A | 6/1992 | Rosen | |
| 5,682,687 | A * | 11/1997 | Arai | 36/97 |
| 5,765,296 | A * | 6/1998 | Ludemann et al. | 36/51 |
| 5,813,146 | A | 9/1998 | Gutkowski et al. | |
| 6,438,872 | B1 * | 8/2002 | Chil et al. | 36/97 |
| 7,080,468 | B2 * | 7/2006 | Miller et al. | 36/97 |
| 7,444,768 | B2 * | 11/2008 | Friton | 36/50.1 |
| 7,634,861 | B2 | 12/2009 | Kilgore | |
| 7,818,900 | B2 * | 10/2010 | Cavasin | 36/97 |
| 7,895,772 | B2 * | 3/2011 | Mariacher | 36/113 |
| 2003/0159312 | A1 * | 8/2003 | Farys et al. | 36/51 |
| 2004/0107604 | A1 * | 6/2004 | Ha | 36/97 |
| 2005/0097775 | A1 | 5/2005 | Yoon | |
| 2006/0242862 | A1 * | 11/2006 | Chelani | 36/114 |
| 2007/0039208 | A1 | 2/2007 | Bove et al. | |
| 2008/0040950 | A1 | 2/2008 | Mariacher | |
| 2009/0183392 | A1 * | 7/2009 | Shane | 36/97 |
| 2010/0199522 | A1 * | 8/2010 | Hwang | 36/102 |
| 2011/0047826 | A1 * | 3/2011 | Rosen | 36/97 |

FOREIGN PATENT DOCUMENTS

| | | |
|---|---|---|
| CN | 201308146 | 9/2009 |
| CN | 201409515 | 2/2010 |
| CN | 201418414 | 3/2010 |
| EP | 1529456 | 5/2005 |
| EP | 2238848 | 10/2010 |
| WO | 2006100612 | 9/2006 |

* cited by examiner

EXPANDABLE SHOE

TECHNICAL FIELD

This invention relates to shoes generally, more particularly to shoes with comfortable fit features that adjust to the size of the foot.

BACKGROUND OF THE INVENTION

Shoes are made in many sizes, for men, women and children. Since feet sizes vary remarkably between individuals, commercially available, ready-to-wear shoes are made in numerous sizes. These sizes vary from sizes 3.5 to 15 for men, sizes 5 to 13.5 for women and sizes 5 to 13 for children. In order to find a reasonable semblance of custom-fit for the customers, shoe manufacturers make all shoes in all of the above sizes and often in ½ sizes. Even with such a wide variety of sizes of available shoes, often the wearer will find their shoes not fit perfectly. This is due to the fact that not only the length of their feet but also the width will determine how well they tolerate the shoes. In the case of children, the growth in size of their feet, commensurate with their overall growth often makes the parents' task of finding a good fit daunting. And, they will necessitate frequent replacement with larger and larger size shoes.

The present invention addresses all of the above issues adequately. By providing expandable (but still sturdy) stretches of elastic material at strategic locations in the top portion of the shoes, it is anticipated that only a few sizes of shoes will be necessary for all age groups and both genders. It is further anticipated that a vast majority of adults will fall within one medium size; this is so because it is easy with this invention to expand sufficiently to accommodate a significant range of feet sizes.

Prior art patents on shoes as in EP1529456 teach an expandable orthopedic type shoe that expands to accommodate a swollen foot.

In U.S. Pat. No. 3,404,468 a shoe has stitching moved inward forming somewhat of a U where the sides join the sole wherein the foot is able to expand widthwise. This patent is called "Moccasin Shoe" and it provides for expandable width and a comfortable feeling due to the fact that the leather upper is attached to the sole inboard of the edges so that the shoe can stretch. None of these shoes provides a way for the shoe to adjust to accommodate larger sizes because they fail to provide expansion upward, sideways and lengthwise.

SUMMARY OF THE INVENTION

An expandable shoe has a top portion, a pair of side portions, a back portion, a sole, a heel and a first elastic member. The first elastic member joins the top portion to the pair of side portions at a critical location which is at the junction of the top portion and the side portions. The first elastic member is in the shape of an inverted "U" which substantially follows the outer periphery along the edges of the sole continuously from the front of the sole extending along the sides spaced by the side portion. The expandable shoe may further have a second elastic member joining the back portion to the side portions at the critical locations at the junctions of the back and side portions and the junctions of the back and the rear of the sole. The second elastic member is in the shape of an upright "U".

Preferably, the heel is adjustable to be positioned in various positions along the rear of the shoe. The heel location on the sole is adjustable to match the stretched shoe length. The sole may have a joint slidable to allow the length of the shoe to increase. The sole has an interlocking surface mating with a complimentary interlocking surface on the heel to fix the heel location on the shoe. The heel and sole are affixed together at the interlocking surfaces and clamped together by a fastener.

The first elastic member is stretchable to allow the shoe to move in the length, width or height directions in response to the size of the foot.

The second elastic member is stretchable to allow the rear of the shoe to move in the width or length direction in response to the size of the foot.

The expandable shoe can be made of a leather or any suitable upper construction material including the top portion, side portions and back portion. The first elastic member is made of a braided elastic material. The braided elastic is a composition of polyester and rubber. The second elastic member is made of a braided elastic material. The first elastic member can stretch a distance at least twice its unstretched width or length. Similarly, the second elastic member can stretch a distance at least twice its unstretched width or length.

BRIEF DESCRIPTION OF THE DRAWINGS

The invention will be described by way of example and with reference to the accompanying drawings in which.

DETAILED DESCRIPTION OF THE INVENTION

With reference to FIGS. 1A-8B, the expandable shoe made according to the present invention is illustrated. The shoe 10 as shown is in the style of a men's loafer. This is an exemplary embodiment illustrating the various design features of the inventive concept. It is understood that the shoe could be made in any number of styles in men's, women's or children's shoes. The shoes can be laced or otherwise slipped on as illustrated. The inventive concept is not limited to the exemplary shoe as illustrated but is provided only for purposes for defining the unique structure of the shoe as it relates to the various components which enable it to expand from an unstretched relaxed version by two or more shoe sizes in terms of length, width and height as required to accommodate various sizes of feet.

Figure 1A:
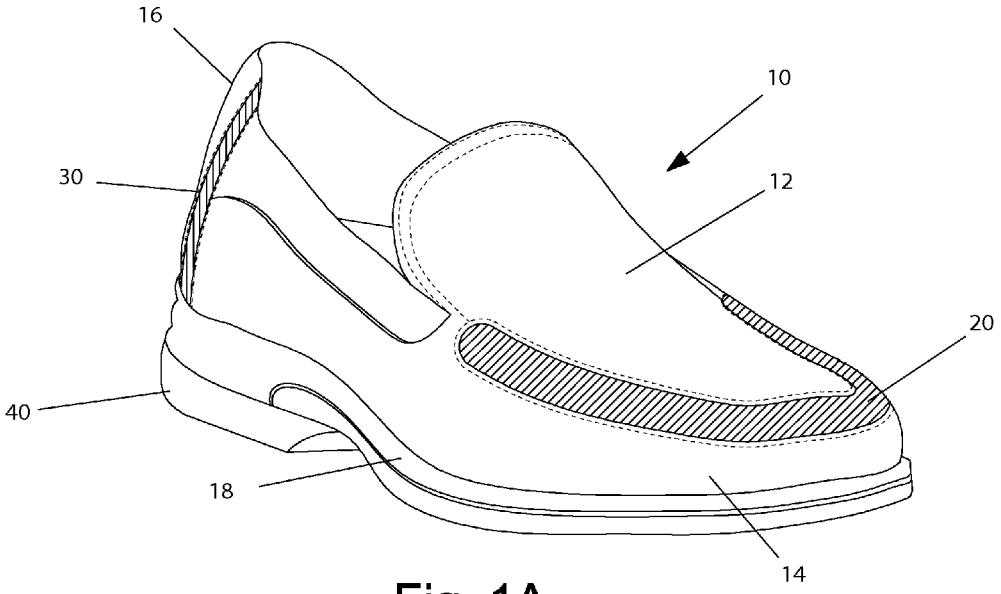
FIG. 1A is a perspective view of the expandable shoe of the present invention in an unstretched relaxed position.
Figure 1B:
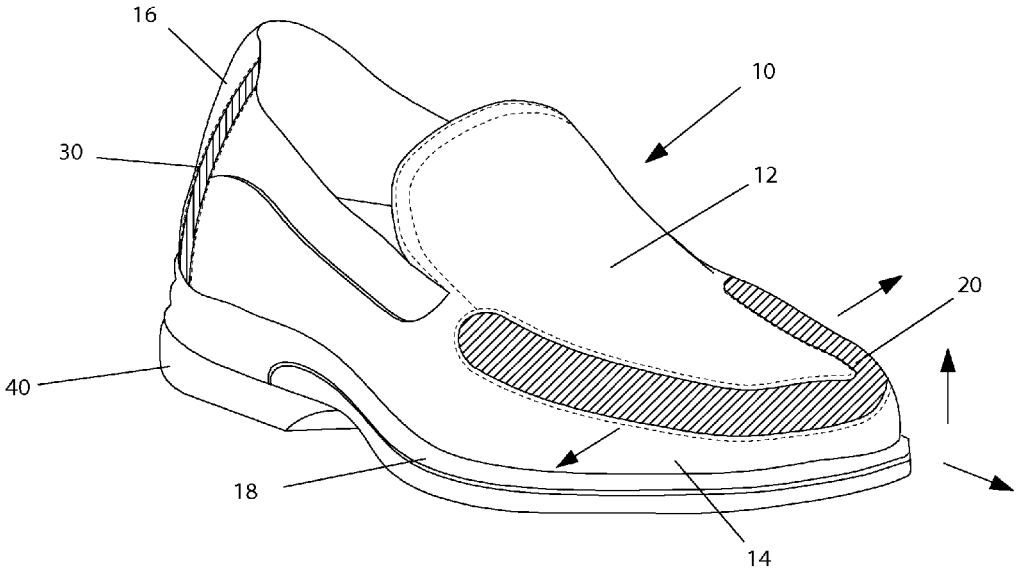
FIG. 1B is the same perspective view as shown in FIG. 1A, but wherein the front portion of the shoe is shown stretched in the directions indicated by the arrows.

With reference to FIG. 1A, the shoe 10 is shown in a perspective view wherein the shoe 10 is relaxed and unstretched. As illustrated, the shoe 10 has an upper leather portion in the exemplary shoe embodiment. This upper leather portion has a top portion 12, one or more side portions 14 and a back portion 16. Connected to the upper leather portion is a sole 18 and a heel 40. In addition, the expandable shoe 10 has a first elastic member 20 that joins the top portion 12 to the one or more side portions 14 at the junction of the top portion 12 and the side portions 14. The first elastic member 20 is in the shape of an inverted "U" extending along the front of the shoe 10 rearwardly. As shown in FIG. 1A, in the rear portion of the shoe 10 there may be a second elastic member 30 which joins the back portion 16 to the one or more side portions 14 at the junction between the back portion 16 and the side portions 14. This elastic member 30 is further attached to the rear of the sole 18. In this fashion the second elastic member 30 is in the shape of an upright "U" as illustrated.

In each of the embodiments, FIGS. 1A, 2A, 3A, 4A, 5A, 6A and 7A the shoe 10 is shown in its unstretched or relaxed position. As shown in the side view of FIG. 2A, phantom lines exterior of the shoe are provided that show how the shoe 10 can be stretched two or more shoe sizes in terms of length and width as well as height. This feature is accommodated in the front portion by the elastomeric member 20. As shown, the elastomeric member 20 overlaps a portion of the side portions 14 and extends over the top 12 slightly. This provides a stretching zone that enables the top 12 connected to the one or more sides 14 of the shoe 10 to be affixed securely on the upper edges of the sides. The sides 14 along the bottom edges being attached directly to the sole 18 of the shoe 10 as is normally done, but the one or more side portions 14 are allowed to flex and stretch outwardly and lengthwise to accommodate larger feet and the top 12 affixed to the first elastic member 20 can move vertically.

Figure 2A:
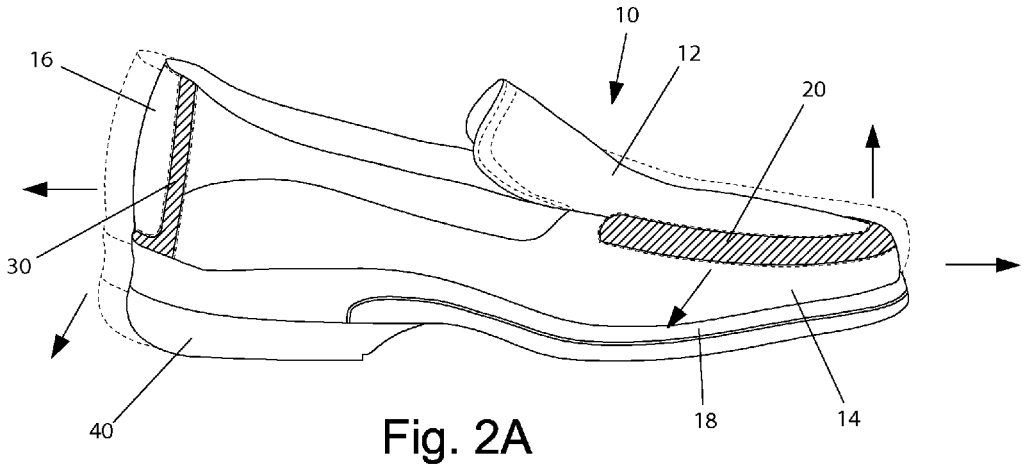
FIG. 2A is a side view of the unstretched shoe of FIG. 1A, but with phantom or dashed lines showing how the front and rear portions of the shoe can be stretched.
Figure 2B:
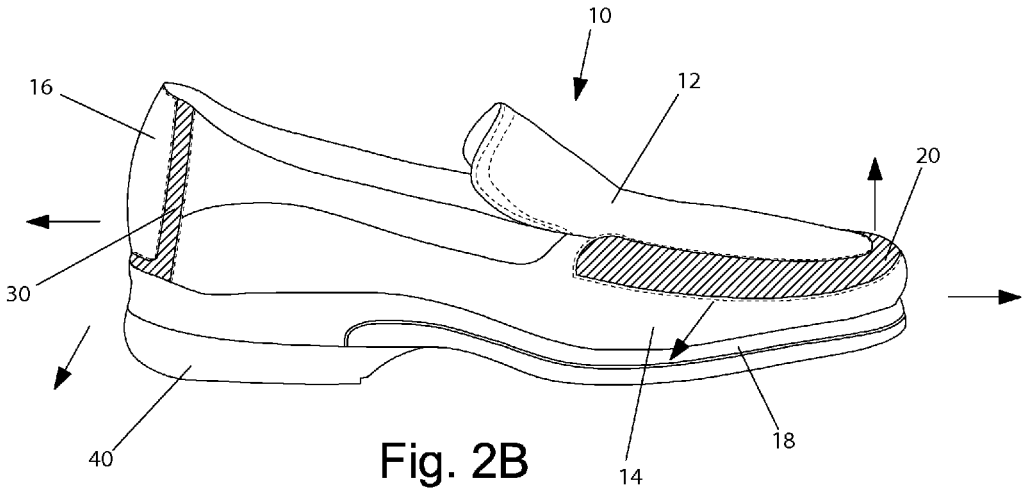
FIG. 2B is the side view of the stretched shoe.
Figure 3A:
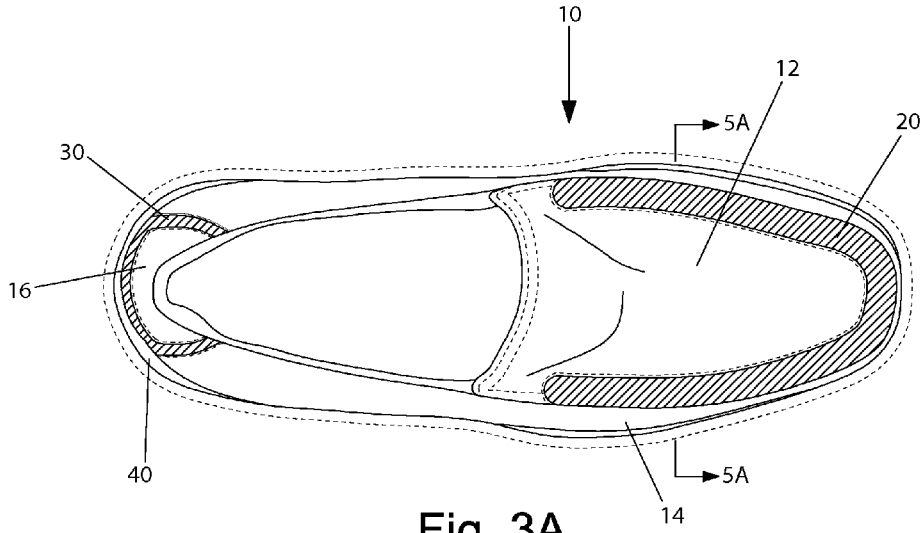
FIG. 3A is a top view looking down at the unstretched shoe, the phantom lines exhibiting the stretched shoe.
Figure 3B:
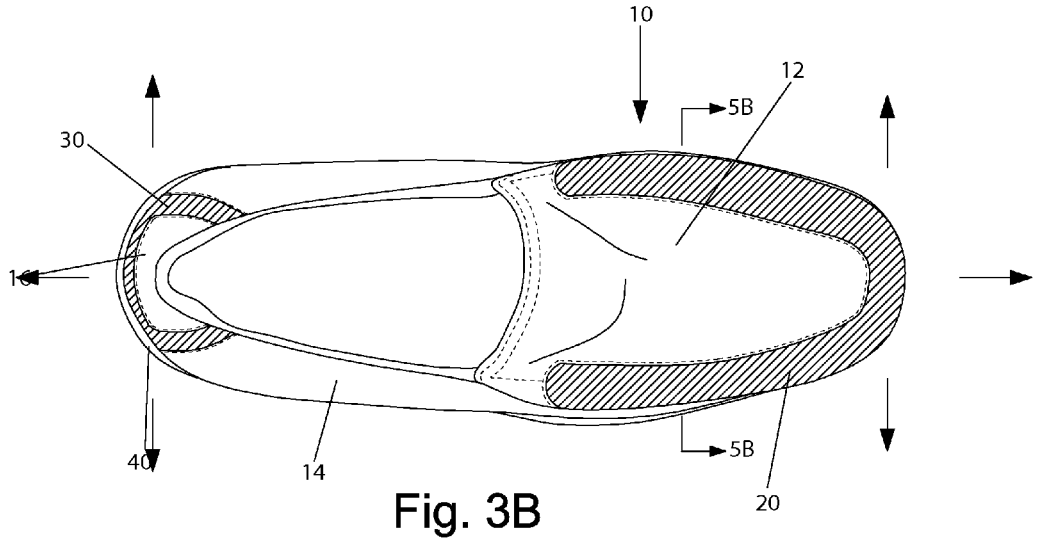
FIG. 3B is the top view of the stretched shoe.

The stretched version of the shoe is illustrated in FIGS. 1B, 2B, 3B, 4B, 5B, 6B and 7B. As can be seen, the shoe 10, in the stretched version can stretch lengthwise, widthwise and heightwise as clearly illustrated in the various figures. As shown in FIG. 3B, the first elastomeric member is the inverted "U" which is directly spaced by the side portions and over the sole outer edges along the front and the sides of the shoe. As shown, the opening for the foot is spaced behind the first elastomeric member.

Figure 4A:
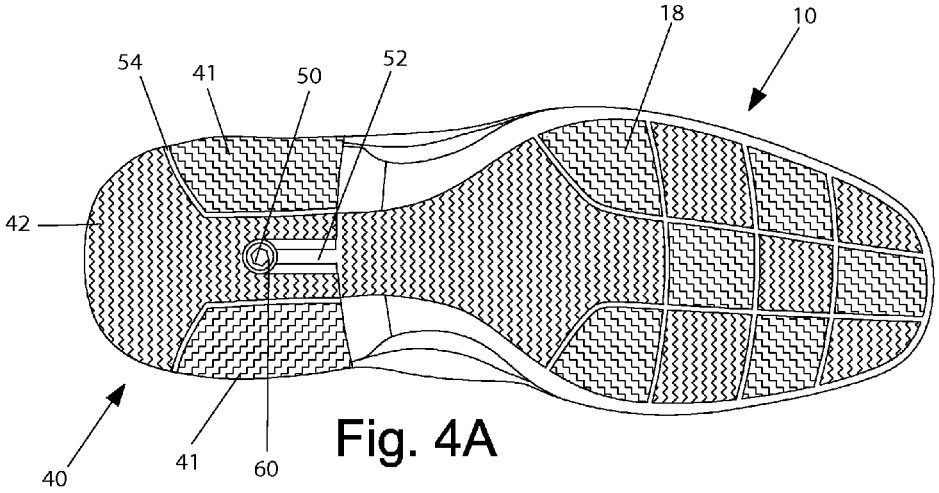
FIG. 4A is a bottom view of the expandable shoe showing the heel and sole of the shoe in an unstretched or small size.
Figure 4B:
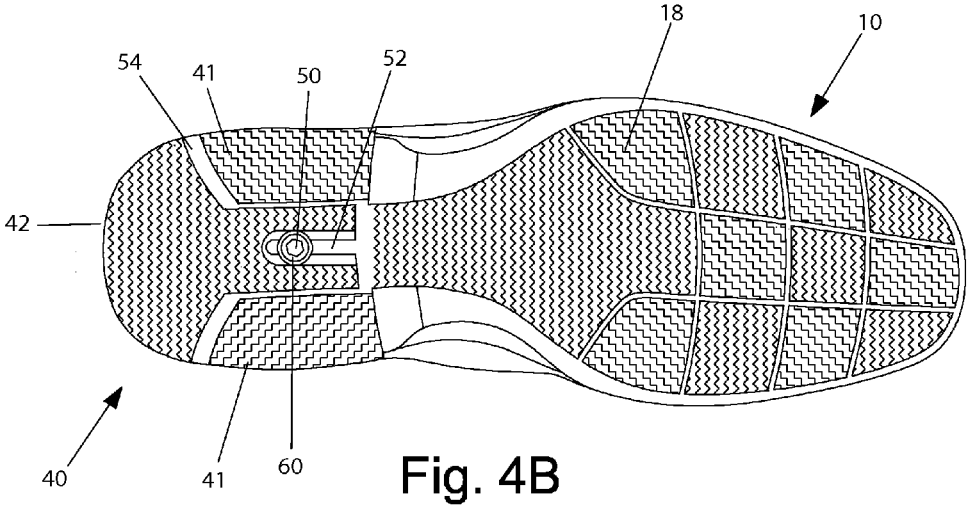
FIG. 4B is a bottom view of the expandable shoe showing the heel being adjusted to match a longer stretched shoe size.
Figure 5A:
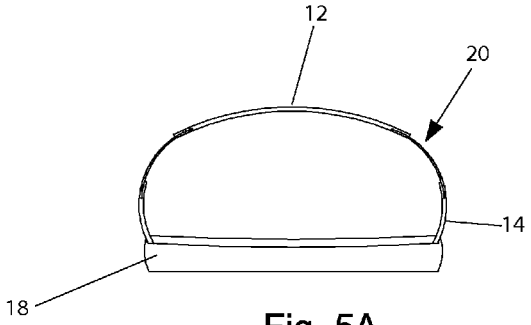
FIG. 5A is a cross sectional view of a front portion of the unstretched shoe taken along lines 5A-5A of FIG. 3A.
Figure 5B:
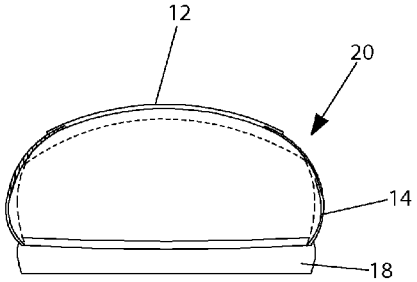
FIG. 5B is a cross sectional view of a front portion of the stretched shoe taken along lines 5B-5B of FIG. 3B.
Figure 6A:
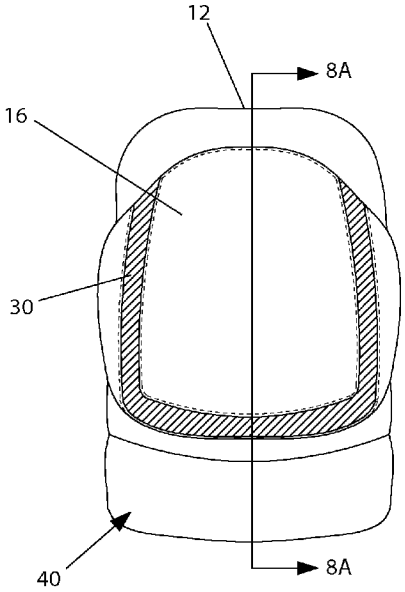
FIG. 6A is an end view of the back portion and heel of an unstretched expandable shoe.
Figure 6B:
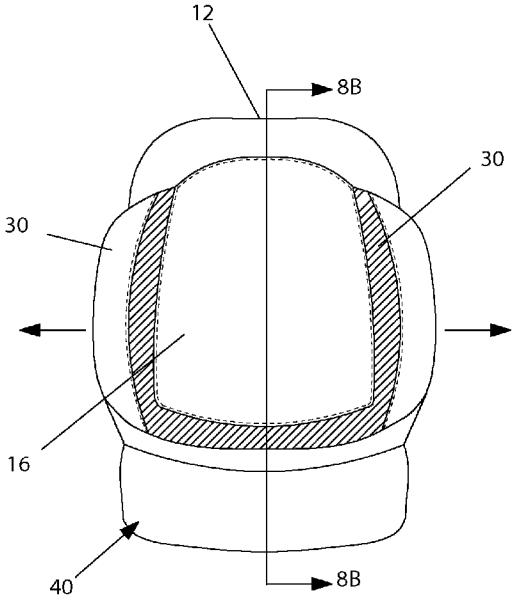
FIG. 6B is an end view of the back portion and heel of a stretched shoe.
Figure 7A:
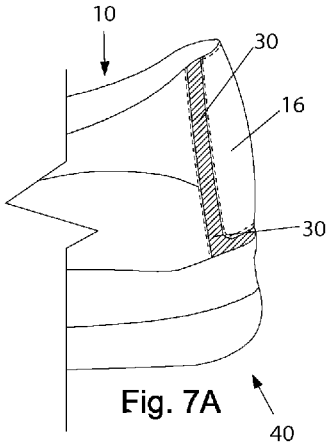
FIG. 7A is a partial side view of the back portion of the expandable shoe.
Figure 8A:
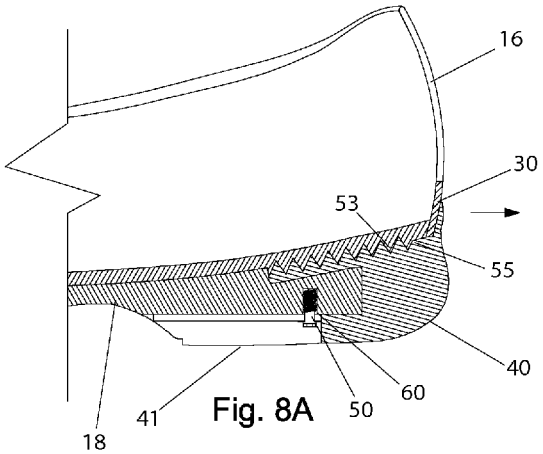
FIG. 8A is a cross section of the rear portion of the shoe taken along lines 8A-8A of FIG. 6A showing the heel in a normal unadjusted position.
Figure 7B:
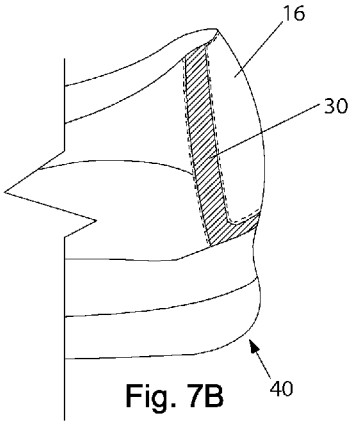
FIG. 7B is a partial side view of FIG. 7A, but with the back portion shown stretched.
Figure 8B:
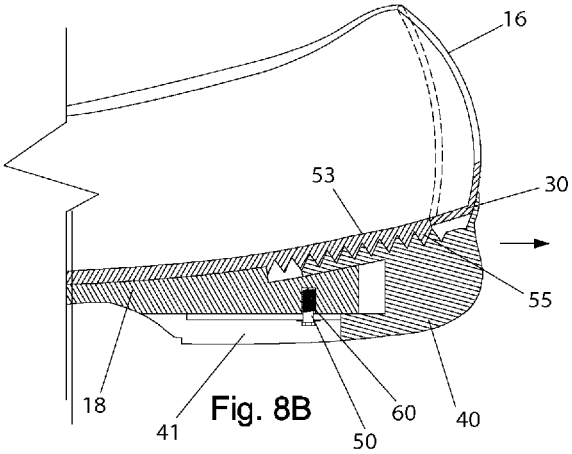
FIG. 8B is the cross section of the rear portion of the shoe taken along lines 8B-8B of FIG. 6B showing the heel in an adjusted position for a stretched length shoe.

An optional, but important aspect of the present invention has a heel 40 that is adjustable that can be positioned in various positions along the rear of the shoe 10. The heel 40, as shown, is fastened by a male threaded fastener member 50 to a female fastener member 60 affixed to the underside of the shoe 10 in the sole 18 as shown in FIGS. 8A and 8B. As initially shown in FIG. 4A, the heel 40 is positioned such that it is secured against the sole 18 shown illustrated with the fastener 50 located in the slot 52. When the heel 40 is moved rearwardly as illustrated in FIG. 4B, a gap 54 is created along each side of the heel 40. Portions 41 of the heel 40 are fixed and provide lateral support as does the rear of the slidable heel portion 42 as illustrated in FIGS. 4A and 4B. As the fastener 50 is clamped, this heel portion 42 is securely affixed to the bottom of the shoe 10. In order to accommodate the locking of the heel 40 to the bottom of the shoe 10 serrations 53, 55 are provided that interlock. These complimentary locking serrations 53 and 55 enable the heel portion 42 when moved from the position shown in FIG. 8A which is a normal relaxed unstretched shoe of the smallest size to a larger size shown in FIG. 8B to be locked in that position. When the heel 40 has the portion 42 moved rearwardly and secured by the fastener 50 as illustrated in FIG. 8B the serrations 55 are gapped to accommodate the lengthening of the shoe 10 in the rear portion 16. This feature enables the shoe 10 to maintain a very stable base for the wearer so that his heel is fully supported and not overhanging the rearward portion of the heel 40. The vertical shaped "U" is shown in FIGS. 6A, 6B, 7A and 7B allow the shoe 10 to expand in a widthward direction at the rear of the shoe 10 shown best in FIG. 3B and also to extend lengthwise as best shown in FIG. 8B. This expansion of the rearward portion of the shoe 10 in conjunction with the forward expansion of the shoe 10 allowed by the first elastomeric member 20 means that the combination of the first and second elastomeric members 20 and 30 enable the shoe 10 to expand at least two or more sizes in terms of length and width dependent on the size of the foot. This advantageously allows the shoe 10 to fit comfortably and securely as the upper leather portions are secured to the sole 18 of the shoe 10 while the elastomeric members 20, 30 provide a means for which the shoe 10 can expand and stretch so it will comfortably fit the foot as either the foot grows in the case of children or in the case of swelling of the foot due to an injury. Ideally the shoe 10 is purchased such that it fits under the normal conditions; however, as the foot size increases due to growth or injury the shoe 10 will expand to accommodate this.

While the shoe 10 as defined in the exemplary embodiment has a leather upper construction of the various components of the one or more sides 14, top 12 and back 16 of the shoe 10 it is also understood that synthetic materials and/or cloth or woven materials could be used in conjunction with the stretchable elastomeric members 20, 30. The bottom of the shoe 10 preferably can be a combination of rubber heel and sole or leather sole and rubber heel, it makes no difference to the inventive features of the shoe 10 which material is chosen for the sole 18.

It is preferred that both the front inverted "U" 20 and the rear vertical "U" 30 be made of an elastic material that is strong yet stretchable, one example being a braided elastic material. These braided elastic materials are manufactured using a composition of materials such as polyester and rubber and are available in many colors and widths. Braided elastic is often used in waistbands, sleeves, necklines and leg bands. This kind of elastic is also used in casings. It becomes narrower when sewn through as the needle pierces the rubber causing a loss of stretch or recovery. This is an important phenomenon in that the present invention preferably utilizes sewn seams so that it can create non-stretch zones in the location of the stitching or weaving to the tops and sides of the elastomeric material. This non-stretch zone provides a secure attachment of the inverted and vertical "U" members 20, 30 to the other parts of the shoe 10. The elastomeric members 20, 30 can be folded or doubled up in the stitch areas if so desired to provide additional stiffness and strength in the regions of attachment. Preferably, however, the overlap of the elastomeric members 20, 30 is such that multiple stitching can be applied. When the elastomeric members 20, 30 are attached they are designed in such a way to be shrink resistant and to stay unaffected by chlorine or salt water which makes them an attractive addition to a shoe in that they can be made in a variety of colors and patterns that greatly enhance the visual appearance of the shoe 10. However, this elastic material can be made very durable and strong so that it can easily provide the necessary performance needed in a shoe. The stretch zone provided between the joined top 12 and sides 14 or the sides 14 and back portion 16 of the shoe 10 is dependent on the elastomeric member 20 or 30 and can enable the shoe 10 to increase by at least two sizes. This stretch can be facilitated by providing more or less stretch within the elastic material such that the stretch can be more or less dependent on the performance requirements of the shoe 10. It is important that the shoe 10 fit snugly on the wearer's foot and not too loosely that it becomes uncomfortable during normal wear. To accomplish this, the selection of the elastic material must be such that it has a proper amount of stretch, however, is not so stretch-resistant that as the foot swells, the elastic material will resist so strongly that it is uncomfortable to wear. To balance this, adjustments must be made in the elastic material so that it has the proper amount of stretch over a proper amount of distance to accommodate an adjustment in shoe size. Ideally, as illustrated in the various embodiments, the braided material will stretch at least two times its length. Accordingly, if two shoe sizes are needed and the two sizes are greater than a half an inch, then the stretch must be able to accommodate half an inch to increase for an example in length. Accordingly, the stretch can be adjusted smaller so that less stretch is provided, these things are tunable and the shoe can be made in such a fashion that it may only adjust one size, or preferably, two or more sizes by the type or amount of elastic material used between the various components. This and the stretchability of the members 20 and 30 provides for the increase in shoe size.

While the shoe in the illustrated embodiments shows a front portion as an inverted "U" with a combination with a rear portion and an adjustable heel, it is understood that the shoe could be manufactured with only the front portion expandable or only the rear portion expandable. In such a case, the expandable rear portion preferably is as shown in FIGS. 2A and 2B and throughout the various embodiments with only a rear portion and the shoe could be manufactured normally without the addition of the expandable front portion if so desired. This may be helpful in women's shoes and or youth shoes wherein an expandable front portion may not be desired. Alternatively, the rear portion may be fixed and the front portion simply expandable and all these various combinations are well within the scope of the invention as claimed. In addition, due to the nature of the shoe 10, as the shoe expands more than one size it was determined that the heel 40 preferably should be adjustable. This feature may or may not be necessary depending on the amount of stretch that is being attempted by the expandable shoe 10. If, for example, the front portion of the shoe expands but not the rear, the heel 40 can be fixed and not adjustable. On the other hand, if the rear portion of the shoe 10 is adjustable, it is believed preferable the heel 40 be adjustable. Alternatively, if in fact the heel portion is not adjustable and rear portion is allowed to be expandable it is understood that the shoe 10 may slightly overlap the heel 40. For this reason, it was determined that the heel 40, in most occurrences, should be movable along with the rear portion. These and other alternative combinations are possible with the shoe 10.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. An expandable leather shoe comprising:

an upper leather portion having a top portion, one or more side portions and a back portion;

the top portion covering a front portion of the shoe;

the side portion, the side portion being wrapped about a front closed end of the shoe and extending rearwardly along each side of the shoe to ends;

the back portion, the back portion joining the ends of the side portion;

a sole, the sole being fixed to the side portion from the front portion and extending to the back portion;

a heel, the heel being attached to the sole; and a first elastic member joining the top portion to the side portion at a junction of the top portion and the side portion, the first elastic member being in a shape of an inverted "U" extending along the front of the shoe, the elastic member having sides spaced by the top portion and closed end at the front closed end of the shoe extending from the front portion of the shoe spaced between the top portion and side portion, the first elastic member substantially following the outer periphery along the edge of the sole continuously from the front of the sole extending along the sides and spaced by the side portion from the front directly along the sides wherein the first elastomeric member at the closed end is sewn or otherwise fixed to and overlaps a portion of the side portion wrapped about the front and extends at least partially along each side of the shoe between the top portion and the side portion and extends over the top portion to form a stretching zone along the front of the shoe allowing the one or more sides to flex and stretch outwardly widthwise and lengthwise and the top portion to move vertically to accommodate larger feet, wherein the first elastomeric member is spaced forward of a foot insertion cavity of the expandable leather shoe.

2. The expandable shoe of claim 1 wherein the heel is adjustable to be positioned in various positions along a rear of the shoe to increase or decrease the shoe length.

3. The expandable shoe of claim 1 wherein the first elastic member is stretchable adapted to expand the shoe to move in a length and a width and a height directions in response to a size of a foot being inserted therein.

4. The expandable shoe of claim 1 wherein the second elastic member is stretchable adapted to expand the rear portion of the shoe to move in a width and a lengths direction in response to a size of a foot being inserted therein.

5. The expandable shoe of claim 1 wherein the heel location on the sole is adjustable to match a stretched shoe length.

6. The expandable shoe of claim 1 wherein the sole has a joint slidable to allow a length of the shoe to increase.

7. The expandable shoe of claim 1 wherein the sole has an interlocking surface mating with a complimentary interlocking surface on the heel, the combination of the interlocking surface and the complimentary interlocking surface to fix the heel location on the shoe.

8. The expandable shoe of claim 7 wherein the heel and sole are affixed together at the interlocking surfaces and clamped together by a fastener.

9. The expandable shoe of claim 1 wherein the first elastic member is made of a braided elastic material.

10. The expandable shoe of claim 9 wherein the braided elastic is a composition of polyester and rubber.

11. The expandable shoe of claim 1 wherein the first elastic member is stretchable by a distance at least twice an unstretched width or length.

12. An expandable leather shoe comprising:

an upper leather portion having a top portion, one or more side portions and a back portion;

the top portion covering a front portion of the shoe;

the side portion, the portion being wrapped about a front closed end of the shoe and extending rearwardly along each side of the shoe to ends;

the back portion, the back portion joining the ends of the side portion;

a sole, the sole being fixed to the side portion from the front portion and extending to the back portion;

a heel, the heel being attached to the sole;

a first elastic member joining the top portion to the side portion at a junction of the top portion and the side portion, the first elastic member being in a shape of an inverted "U" extending along the front of the shoe, the elastic member having sides spaced by the top portion and closed end at the front closed end of the shoe extending from the front portion of the shoe spaced between the top portion and side portion, the first elastic member substantially following the outer periphery along the edge of the sole continuously from the front of the sole extending along the sides and spaced by the side portion from the front directly along the sides wherein the first elastomeric member at the closed end is sewn or otherwise fixed to and overlaps a portion of the side portion wrapped about the front and extends at least partially along each side of the shoe between the top portion and the side portion and extends over the top portion to form a stretching zone along the front of the shoe allowing the one or more sides to flex and stretch outwardly widthwise and lengthwise and the top portion to move vertically to accommodate larger feet, wherein the first elastomeric member is spaced forward of a foot insertion cavity of the expandable leather shoe; and a second elastic member joining the back portion to the side portion and a rear of the sole, the second elastic member being in a shape of an upright "U", the back portion being extendable relative to the foot by the stretching of the second elastic member outwardly widthwise and lengthwise and wherein the combination of the first and second member allows larger feet to be accommodated.

13. The expandable shoe of claim 12 wherein the second elastic member is made of a braided elastic material.

14. The expandable shoe of claim 12 wherein the second elastic member is stretchable by a distance at least twice an unstretched width or length.

* * * * *